United States Patent [19]

Nakamura et al.

[11] Patent Number: 4,528,974

[45] Date of Patent: Jul. 16, 1985

[54] PROTECTIVE GUARD FOR COMBUSTION APPLIANCE

[75] Inventors: Kazuharu Nakamura; Motoki Matsumoto, both of Nagoya; Osamu Niha, Aichi; Yoshio Suzuki, Nagoya, all of Japan

[73] Assignee: Toyotomi Kogyo Co., Ltd., Aichi, Japan

[21] Appl. No.: 593,000

[22] Filed: Mar. 23, 1984

[30] Foreign Application Priority Data

Mar. 24, 1983 [JP] Japan ..... 58-43178[U]

[51] Int. Cl.[3] ..... F24C 15/36

[52] U.S. Cl. ..... 126/202; 256/26; 256/1; 160/DIG. 9

[58] Field of Search ..... 256/26, 25, 1; 160/352, 160/DIG. 9; 126/202, 201

[56] References Cited

U.S. PATENT DOCUMENTS 706,596 8/1902 Poyner ..... 126/202
1,307,817 6/1919 Graybeal ..... 160/DIG. 9

FOREIGN PATENT DOCUMENTS 5057 of 1911 United Kingdom ..... 126/202
708579 3/1952 United Kingdom .
851708 10/1960 United Kingdom ..... 126/202
895951 5/1962 United Kingdom ..... 126/202
2102115 1/1983 United Kingdom ..... 126/202

*Primary Examiner*—Andrew V. Kundrat
*Attorney, Agent, or Firm*—Pollock, Vande Sande & Priddy

[57] ABSTRACT

A protective guard for a combustion appliance is disclosed which comprises a front frame having a pair of vertical frame portions between which a protective guard body is provided; a pair of side frames which at one end are rotatably supported on the vertical frame portions of said front frame on both ends thereof; and a cross beam member on both ends thereof slidably engaging the side frames. When the cross beam member is positioned at the upper ends of the side frames, the side frames are so rotatable about the axes of the upper ends of the vertical frame portions of the front frame that the side frames are able to be inwardly folded, and when the cross beam member is positioned at the lower ends of the side frames, the side frames are so fixed in an unfolded manner that they cannot be rotated. Thus, it will be noted that the protective guard can be fixed so that it can surround a combustion appliance in a stable manner.

5 Claims, 3 Drawing Figures

PROTECTIVE GUARD FOR COMBUSTION APPLIANCE

BACKGROUND OF THE INVENTION

1. Field of the Invention

This invention relates to a protective guard for a combustion appliance such as an oil heater or a gas heater.

2. Description of the Prior Art

A protective guard for a combustion appliance has been proposed which may be folded to save a space when it is not to be used. However, such a foldable protective guard has a poor stability due to movement of the components of the protective guard.

Another prior art, protective guard is of knockdown type which is by reinforcing parts which prevent guard parts from being unnecessarily moved and provide an increased strength and stability. However, such a protective guard has disadvantages that the reinforcing parts make their assembly troublesome and that the reinforcing parts have the possibility of being lost.

Another prior art, protective guard is placed so that it only surrounds a combustion appliance. However, such a protective guard disadvantageously requires a large space in which it is to be put away and has the possibility of being moved even by a force applied by an infant.

SUMMARY OF THE INVENTION

Accordingly, it is a principal object of the invention to provide a protective guard for a combustion appliance which is adapted to be foldable while having a high strength and stability without using separate parts.

It is another object of the invention to provide a protective guard for a combustion appliance which is adapted to be simple in its construction and assembly.

It is further object of the invention to provide a protective guard for a combustion appliance which is so constructed that it cannot be easily moved.

In accordance with the invention, there is provided a protective guard for a combustion appliance comprising;

a front frame having a pair of vertical frame portions between which a protective guard body is provided;

a pair of side frames which at one end are rotatably supported on the vertical frame portions of the front frame on both sides thereof;

and a cross beam member on both ends thereof slidably engaging the side frames between a first position where the cross beam member is at the upper ends of the side frames so that the side frames are rotatable about axes of the upper ends of the vertical frame portions of the front frame, which enables the side frames to be inwardly folded; and a second position where the cross beam member is at the lower ends of the side frames so that the side frames are fixed in an unfolded manner, which prevents the side frames from being rotated.

BRIEF DESCRIPTION OF THE DRAWINGS

The above and other objects and features of the invention will be apparent from the description of the embodiment with reference to the accompanying drawings in which.

DETAILED DESCRIPTION OF THE EMBODIMENT

Figure 1:
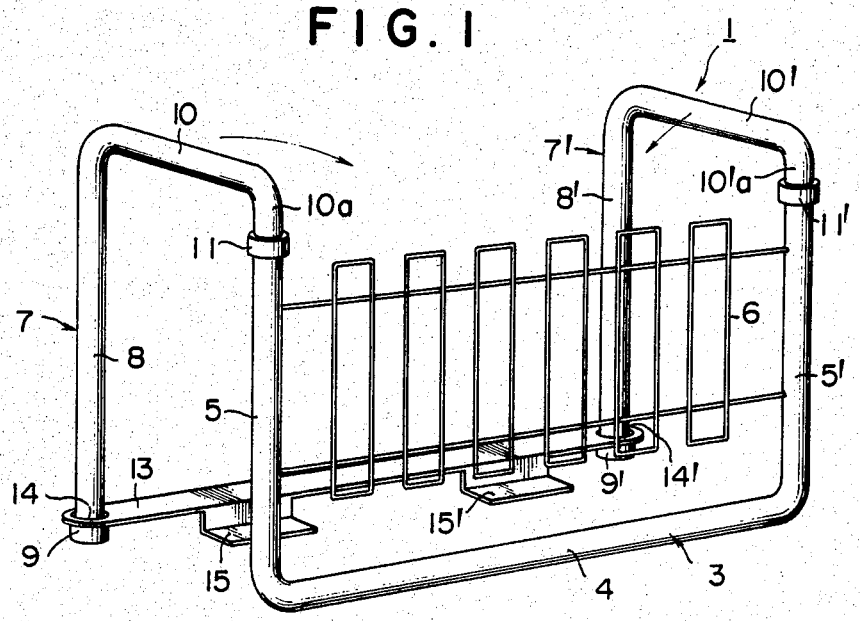
FIG. 1 is a perspective view of an embodiment of a protective guard in accordance with the present invention which is unfolded for use.
Figure 2:
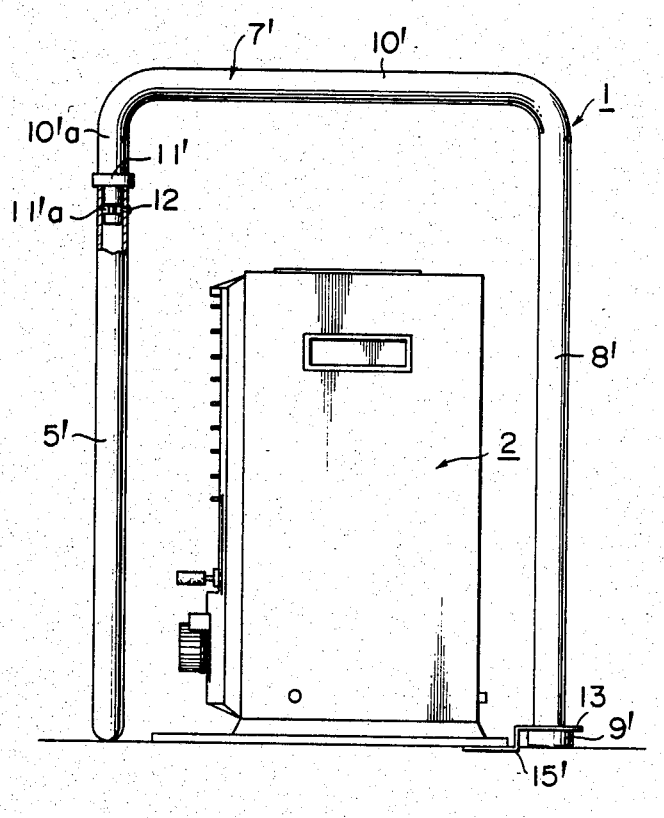
FIG. 2 is a side elevational view of the protective guard of FIG. 1 which is used to surround a combustion appliance.

Referring now to FIGS. 1 and 2, there is shown a protective guard 1 which is used to surround a combustion appliance 2 such as a kerosene room heater. The protective guard 1 comprises a U-shaped front frame 3 which may be formed of bent metal pipe. Thus, it will be noted that the front frame 3 has a lateral frame portion 4 which is placed on a floor and a pair of vertical frame portions 5 and 5' upwardly extending from the both ends of the lateral frame portion 4. A protective guard body 6 is provided between the vertical frame portions 5 and 5'.

The protective guard 1 further comprises a pair of reversely L-shaped side frames 7 and 7' which may be also formed of bent metal pipes, respectively. Thus, it will be noted that the side frames 7 and 7' have vertical frame portions 8 and 8' which have leg caps 9 and 9' secured to the lower ends thereof and placed on the floor and horizontal upper frame portions 10 and 10' which are supported through connection means 11 and 11' on the upper ends of the vertical frame portions 5 and 5'.

The connection means 11 and 11' may be integrally formed of plastic and are constructed in the same manner. The following description will be made in connection with the connection means 11' shown in FIG. 2.

The connection means 11' is fixedly fitted at one end thereof on the upper end of the upper frame portion 10' and loosely fitted in the vertical frame portion 5' to be freely rotated therein. The other end of the connection means 11' is formed at the periphery thereof with a recess **11*a'* which is adapted to receive the distal end of a screw 12 inserted therein through the vertical frame portion 5'. Thus, it will be noted that the connection means 11' is rotatable with respect to the vertical frame portion 5' but is prevented from being removed therefrom by the screw 12**.

The protective guard 1 further comprises a cross beam member 13 which at both ends thereof has holes 14 and 14' provided therein. The cross beam member 13 slidably engages the side frames 7 and 7' at the holes 14 and 14'. The leg caps 9 and 9' serve to prevent the cross beam member 13 from being removed out of the side frames 7 and 7'. A pair of support members 15 and 15' of L-shaped cross section are secured to the cross beam member 13 so that they engage the floor and are placed under the combustion appliance 2 when the protective guard 1 is used to surround the combustion appliance 2. Thus, it will be noted that the protective guard 1 is stably placed when used for the combustion appliance.

Figure 3:
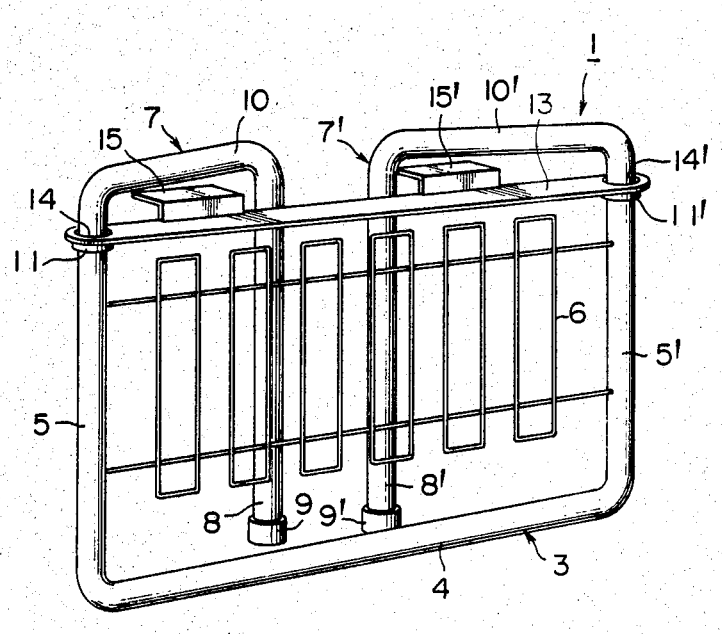
FIG. 3 is a perspective view of the protective guard of FIG. 1 which is folded for being put away.

As shown in FIG. 1, when the protective guard 1 is to be used, after the side frames 7 and 7' are unfolded, the cross beam member 13 is slidably moved until it reaches the leg caps 9 and 9'. As aforementioned, since the combustion appliance 2 is placed on the support members 15 and 15', the protective guard 1 is never unstably moved even though an infant contacts the protective guard 1 by mistake. Since the cross beam member 13 serves to securely fix the side frames 7 and 7' in a spaced manner, the protective guard 1 is stably assembled. When the protective guard 1 is to be put away, the cross beam member 13 is moved upwardly along the vertical frame portions 8 and 8' and then forwardly along the horizontal upper frame portions 10 and 10' until it reaches the connection means 11 and 11', as shown in FIG. 3. Thereafter, the side frames 7 and 7' are inwardly rotated about the axes of the vertical frame portions 5 and 5' of the front frame 3 so that the protective guard 1 is folded as shown in FIG. 3. Thus, it will be noted that the protective guard 1 can be compactly put away.

Although one preferred embodiment of the invention has been illustrated and described with reference to the accompanying drawings, it will be understood that it is by way of example, and that various changes and modifications may be made without departing from the spirit and scope of the invention. For example, although, in the illustrated embodiment, the side frames may be reversely L-shaped, it may be of other form if the cross beam member can slidably engage the side frames. Thus, it will be understood that the invention is intended to be limited only by the appended claims.

What is claimed is:

1. A protective guard for a combustion appliance comprising:

a front frame formed into a U-shape to have a pair of upright frame portions between which a protective guard body is provided;

a pair of side frames rotatably secured at the upper ends thereof to both upper ends of said front frame, respectively;

and a cross beam member on both ends thereof slidably engaging said side frames between a first position where said cross beam member is at the upper ends of said side frames so that said side frames are rotatable about axes of said upper ends of said frame portions of said front frame which enables said side frames to be inwardly folded; and a second position where said cross beam member is at lower ends of said side frames so that said side frames are fixed in an unfolded manner, which prevents said side frames from being rotated.

2. A protective guard for a combustion appliance as set forth in claim 1, wherein the rotatable securing of said side frames to said front frame is carried out through connector means.

3. A protective guard for a combustion appliance as set forth in claim 2, wherein said side frames are reversely L-shaped and at said upper ends thereof have downwardly bent portions rotatably inserted into said connector means.

4. A protective guard for a combustion appliance as set forth in claim 1, wherein said cross beam member has at least one support member secured thereto, and said support member engaging a floor in position to be placed under such a combustion appliance.

5. A protective guard for a combustion appliance as set forth in claim 3, wherein said side frames have leg caps secured to the lower ends thereof, said leg caps serving to prevent said cross beam member from being removed from said side frames.

* * * * *